US008090281B2

(12) United States Patent
Hirota et al.

(10) Patent No.: US 8,090,281 B2
(45) Date of Patent: Jan. 3, 2012

(54) IMAGE FORMING APPARATUS AND TONE CORRECTION METHOD

(75) Inventors: Soh Hirota, Hoi-gun (JP); Tetsuya Sakai, Toyokawa (JP); Takashi Harashima, Toyohashi (JP); Kazuomi Sakatani, Toyokawa (JP); Masahiro Kouzaki, Toyokawa (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 707 days.

(21) Appl. No.: 12/205,381

(22) Filed: Sep. 5, 2008

(65) Prior Publication Data

US 2009/0067857 A1 Mar. 12, 2009

(30) Foreign Application Priority Data

Sep. 11, 2007 (JP) ..... 2007-235234

(51) Int. Cl.
*G03G 15/00* (2006.01)

(52) U.S. Cl. ..... 399/49; 399/72

(58) Field of Classification Search ..... 399/49, 399/59, 60, 72, 301; 347/116, 254
See application file for complete search history.

(56) References Cited

U.S. PATENT DOCUMENTS

| | | | | |
|---|---|---|---|---|
| 5,510,885 | A * | 4/1996 | Mori et al. | 399/28 |
| 5,995,802 | A * | 11/1999 | Mori et al. | 399/394 |
| 6,335,747 | B1 | 1/2002 | Munakata | |
| 6,934,481 | B2 | 8/2005 | Hama | |
| 6,949,896 | B2 | 9/2005 | Andoh et al. | |
| 2006/0024076 | A1 * | 2/2006 | Kato et al. | 399/49 |
| 2006/0222389 | A1 * | 10/2006 | Kin et al. | 399/49 |
| 2007/0134014 | A1 * | 6/2007 | Kato et al. | 399/49 |
| 2007/0140721 | A1 * | 6/2007 | Shinohara et al. | 399/72 |
| 2008/0019740 | A1 * | 1/2008 | Oouchi | 399/301 |
| 2009/0067860 | A1 * | 3/2009 | Sakai et al. | 399/49 |

FOREIGN PATENT DOCUMENTS

| | | |
|---|---|---|
| JP | 04-087454 | 3/1992 |
| JP | 10-126574 A | 5/1998 |
| JP | 11-218989 | 8/1999 |
| JP | 2002-014505 A | 1/2002 |

(Continued)

OTHER PUBLICATIONS

Decision to Grant Patent issued in corresponding Japanese Application No. 2007-235234 dated Nov. 10, 2009, and an English Translation thereof.

(Continued)

*Primary Examiner* — David Gray
*Assistant Examiner* — Rodney Bonnette
(74) *Attorney, Agent, or Firm* — Buchanan Ingersoll & Rooney PC

(57) ABSTRACT

A tandem-type color image forming apparatus forms a toner pattern and toner markers on an intermediate transfer member. Tone levels in the toner pattern vary in a sub scanning direction, and the toner markers which are a same color with the tone pattern each oppose, in a main scanning direction, a different one of the tone level portions in the toner pattern, each tone level portion representing a different one of the tone levels. Positions of the toner markers in the sub scanning direction are determined to detect densities in the toner pattern corresponding to the determined positions. Tone of image data is corrected in an image formation based on a relationship between the densities and the tone levels corresponding to the determined positions.

6 Claims, 7 Drawing Sheets

FOREIGN PATENT DOCUMENTS

| | | | |
|---|---|---|---|
| JP | 2004-077873 | A | 3/2004 |
| JP | 2005-077681 | | 3/2005 |
| JP | 3648131 | B2 | 5/2005 |
| JP | 2006-133705 | | 5/2006 |
| JP | 2006-349851 | A | 12/2006 |
| JP | 2007-199211 | | 8/2007 |

OTHER PUBLICATIONS

Notification of Reasons for Refusal in JP 2007-235234 dated Jul. 14, 2009, and an English Translation thereof.

* cited by examiner

IMAGE FORMING APPARATUS AND TONE CORRECTION METHOD

CROSS-REFERENCE TO RELATED APPLICATIONS

This application is based on application No. 2007-235234 filed in Japan, the content of which is hereby incorporated by reference.

BACKGROUND OF THE INVENTION (1) Field of the Invention

The present invention relates to an image forming apparatus and a tone correction method, in particular to a technology for performing a tone correction with high accuracy.

(2) Description of the Related Art

In order to realize high image quality, a tandem-type color image forming apparatus performs a process such as a registration correction process or tone correction process as an image stabilization process. It is desirable that time required to perform the image stabilization process be as short as possible, since a delay in an image formation due to the image stabilization process affects users' convenience.

In response to the above need, for example, a technique has been developed to perform a color shift correction control process and a halftone density control process simultaneously in a parallel manner by forming a color shift detection pattern and a halftone density detection pattern on a transport belt (Japanese Laid-Open Patent Application Publication No. 2002-014505). Also, another technique has been developed to form, during a tone correction, on an intermediate transfer belt, a tone patch whose tone varies continuously (Japanese Laid-Open Patent Application Publication No. 2004-077873).

However, when forming a color shift detection pattern on the transport belt or forming a density patch on the intermediate transfer belt, speed of the transport belt or the intermediate transfer belt may vary, causing a shift in a forming position of the color shift detection pattern or density patch. An occurrence of such a positional shift hinders detection of an expected density and thereby an accurate tone correction, preventing the realization of the high image quality as a result.

SUMMARY OF THE INVENTION

The present invention was conceived to solve the above problems, and aims to provide an image forming apparatus and a tone correction method which enable an accurate tone correction even in a case where the speed of the transport belt, intermediate transfer belt or the like varies.

In order to achieve the above aim, the image forming apparatus of the present invention is a tandem-type color image forming apparatus that conveys a toner image or a recording sheet with use of a conveyor, comprising: a toner pattern former operable to form, on the conveyor, a toner pattern in which tone levels vary in a sub scanning direction; a toner marker former operable to form, on the conveyor, toner markers each opposing, in a main scanning direction., a different one of tone level portions in the toner pattern so as to indicate positions of the tone level portions, each tone level portion representing a different one of the tone levels, and the toner markers being a same color as the toner pattern; a position determiner operable to determine the positions in the sub scanning direction by reading the toner markers; a density detector operable to detect a density of each of the tone level portions corresponding to the determined positions; and a corrector operable to correct, in an image formation, tone of image data based on a relationship between the density and a tone level of the corresponding one of the tone level portions.

With the above structure, even when speed of a transport belt, intermediate transfer belt, photosensitive drum or the like varies, the position with respect to the sub scanning direction is determined by referring to a toner marker. Consequently, a density of a portion with a desired tone level in a toner pattern can be detected, enabling an accurate tone correction.

In this case, it is preferable that each of the toner markers is rectangular in shape, a longitudinal direction thereof lying in the main scanning direction, and each of the toner markers has a narrower width, in the sub scanning direction, than the opposing tone level portion.

Also, if the tone levels in the toner pattern vary by 1 in the sub scanning direction, it is possible to detect the density of the tone level in the toner pattern with an even higher accuracy.

Also, the tone correction method of the present invention is a tone correction method used by a tandem-type color image forming apparatus that conveys a toner image or a recording sheet with use of a conveyor, the tone correction method comprising: a toner pattern forming step of forming, on the conveyor, a toner pattern in which tone levels vary in a sub scanning direction; a toner marker forming step of forming, on the conveyor, toner markers each opposing, in a main scanning direction, a different one of tone level portions in the toner pattern so as to indicate positions of the tone level portions, each tone level portion representing a different one of the tone levels, and the toner markers being a same color as the toner pattern; a position determining step of determining the positions in the sub scanning direction by reading the toner markers; a density detecting step of detecting a density of each of the tone level portions corresponding to the determined positions; and a correcting step of correcting, in an image formation, tone of image data based on a relationship between the density and a tone level of the corresponding one of the tone level portions.

By using this method, as with the above case, the accuracy of the tone correction can be improved.

BRIEF DESCRIPTION OF THE DRAWINGS

These and the other objects, advantages and features of the invention will become apparent from the following description thereof taken in conjunction with the accompanying drawings which, illustrate a specific embodiment of the invention.

In the drawings.

DESCRIPTION OF PREFERRED EMBODIMENTS

The following describes a preferred embodiment of an image forming apparatus pertaining to the present invention, using a tandem-type color image forming apparatus as an example and referring to drawings.

[1] Structure of Image Forming Apparatus

First, a structure of the image forming apparatus of the present invention will be described.

Figure 1:
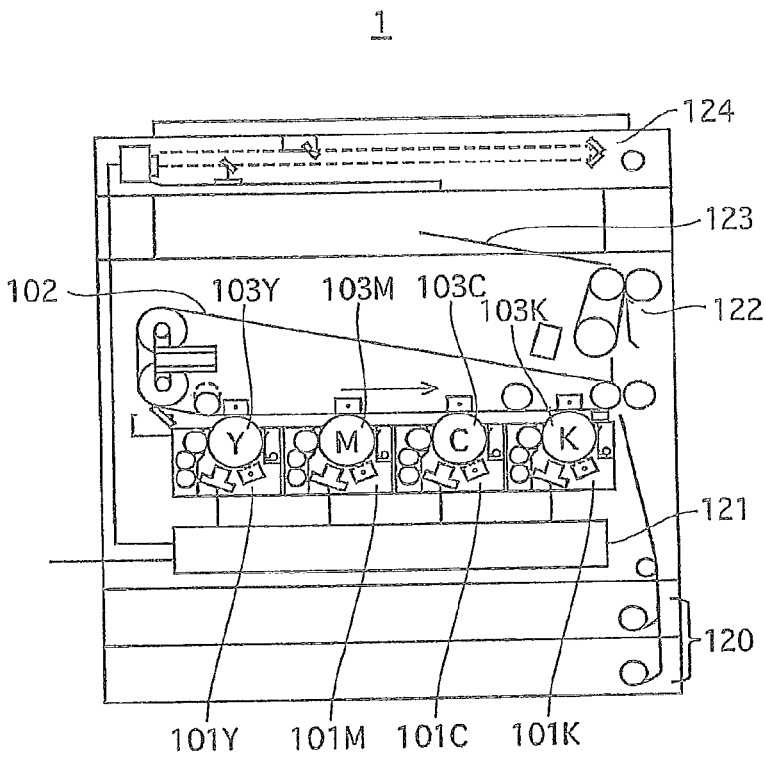
FIG. 1 is a diagram showing a structure of an image forming apparatus of an embodiment of the present invention.

FIG. 1 is a, diagram showing a structure of an image forming apparatus of an embodiment of the present invention. As shown in FIG. 1, an image forming apparatus 1 includes image forming units 101Y to 101K, an intermediate transfer belt 102, a paper feeding device 120, a controller 121, a fixing device 122, a paper ejector 123, and a scanner 124. And, the image forming units 101Y to 101K include photoconductors 103Y to 103K, respectively.

The scanner 124 scans a document and generates image data. The controller 121 receives image data from the scanner 124, an external PC or the like and performs image processing. Also, the controller 121 controls the image forming units 101Y to 101K.

The image forming units 101Y to 101K form a toner image of each color of yellow (Y), cyan (C), magenta (M), and black (K) respectively on the photoconductors 103Y to 103K in accordance with the image data to be formed and transfer the toner images onto the intermediate transfer belt 102.

The toner image on the intermediate transfer belt 102 is transferred onto a sheet of recording paper supplied by the paper feeding device 120 and heat-fixed, by the fixing device 122. After that, the recording paper is ejected to the paper ejector 123.

Figure 2:
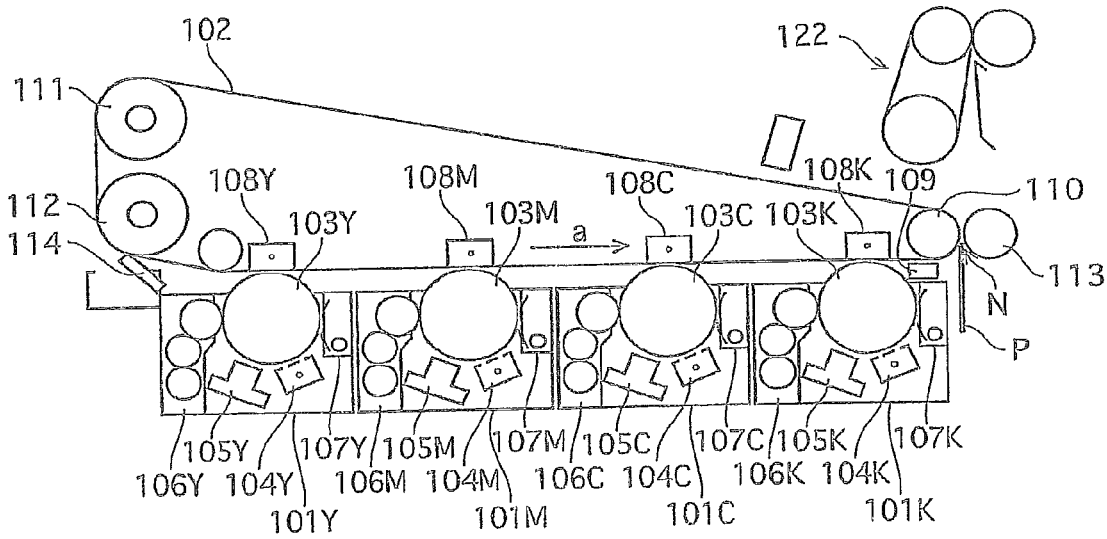
FIG. 2 is an elevation showing an enlarged view at and around an image forming unit and an intermediate transfer belt of an image forming apparatus 1.

FIG. 2 is an elevation showing an enlarged view at and around an image forming unit and an intermediate transfer belt of an image forming apparatus 1. As shown in FIG. 2, the image forming apparatus 1 further includes first transfer devices 108Y to 108K, an optical sensor 109, a roller 110, a driving roller 111, a driven roller 112, a second transfer roller 113, and a cleaner 114.

Additionally, the image forming units 101Y to 101K further include charging devices 104Y to 104K, exposing devices 105Y to 105K, developing devices 106Y to 106K, and cleaners 107Y to 107K, respectively.

Here, a further detailed description will be given on an image forming operation of the image forming apparatus 1. After receiving the image data, the image forming units 101Y to 101K form electrostatic latent images on the photoconductors 103Y to 103K with use of the exposing devices 105Y to 105K, respectively. The electrostatic latent images are developed by the developing devices 106Y to 106K and turned into the toner images of the respective colors. The toner images are transferred onto the intermediate transfer belt 102 in layers by the first transfer devices 108Y to 108K.

The intermediate transfer belt 102 is suspended among the second transfer roller 110, the driving roller 111, and the driven roller 112, and rotation of the driving roller 110 moves the intermediate transfer belt 102 in a direction of an arrow "a" at a constant speed. Also, the fixing roller 113 is disposed opposing the second transfer roller 110 across the intermediate transfer belt 102.

A sheet of recording paper P is transported toward a nip region N formed between the intermediate transfer belt 102 and the fixing roller 113. The toner image on the intermediate transfer belt 102 is transferred on to the sheet of recording paper P at the nip region N by an action of the second transfer roller 110. After that, the recording paper P gets the toner image fixed thereon by the fixing device 122 and is ejected to the paper ejector 123.

When performing an image stabilization process, the image forming units 101Y to 101K form toner patterns, which will be described later, and transfer the toner patterns onto the intermediate transfer belt 102. The toner patterns transferred, onto the intermediate transfer belt 102 are detected by the optical sensor 109. The optical sensor 109 applies light on the intermediate transfer belt and detects an amount of toner and the like by detecting an amount of reflected light.

The toner patterns used in the image stabilization process are not transferred onto the recording paper P but move along with the intermediate belt 102, and are scraped and discarded by the cleaner 114. The cleaner 114 also discards remaining toner by scraping after a, toner image is transferred onto the recording paper P during a regular image forming process.

[2] Image Processing

Next, a description will be given on image processing executed by the controller 121.

Figure 3:
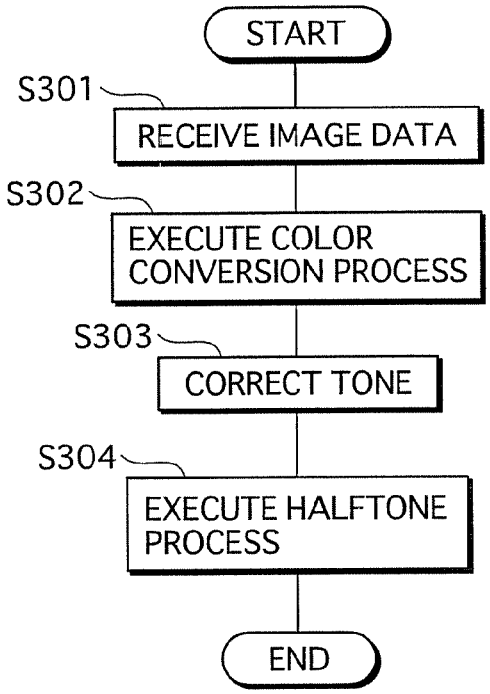
FIG. 3 is a flowchart of a main image processing executed by a controller 121 of the image forming apparatus 1.

FIG. 3 is a flowchart of a main image processing executed by a controller 121 of the image forming apparatus 1. As shown in FIG. 3, upon receiving image data (S301), the controller 121 converts the received image data to 8-bit CMYK signals by performing a color conversion process (S302).

Next, the controller 121 corrects tone, referring to a tone correction table (S 303). The tone correction is performed to always maintain a stable tone characteristic by compensating for variance of sensitivity characteristic or development characteristic of the photoconductor due to variation in a manufacturing process of the image forming apparatus 1, environmental conditions, or a secular change. The tone correction table is referred to during the tone correction and is updated during the image stabilization process.

Following the above process, the controller 121 generates video signals to which a halftone process such as a dithering or an error diffusion has been performed in S 304. Then the exposing devices 105Y to 105K expose the photoconductors by controlling ON/OFF of a semiconductor laser based on the video signals.

[3] Image Stabilization Process

Next, a description will be given on the image stabilization process, particularly on a process relating to update of the tone correction table. The image stabilization process is performed at a predetermined timing, such as after power is turned ON.

Figure 4:
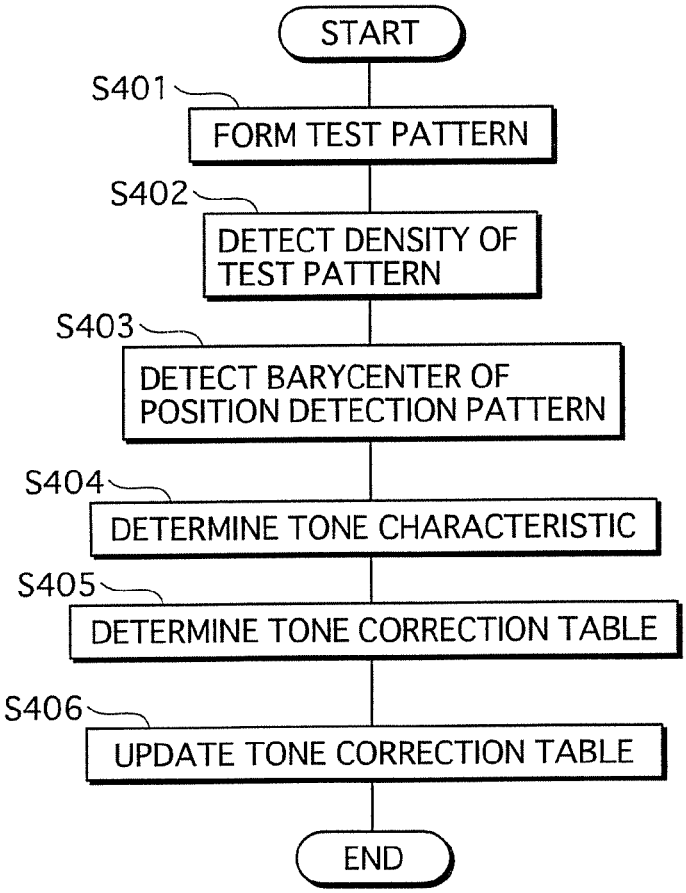
FIG. 4 is a flowchart of an image stabilization process executed by the image forming apparatus 1.

FIG. 4 is a flowchart of an image stabilization process executed by the image forming apparatus 1. As shown in FIG. 4, in the image stabilization, process, the image forming apparatus 1 first forms a test pattern on the intermediate transfer belt 102 (S401) then detects the density of the test pattern (S402).

Figure 5:
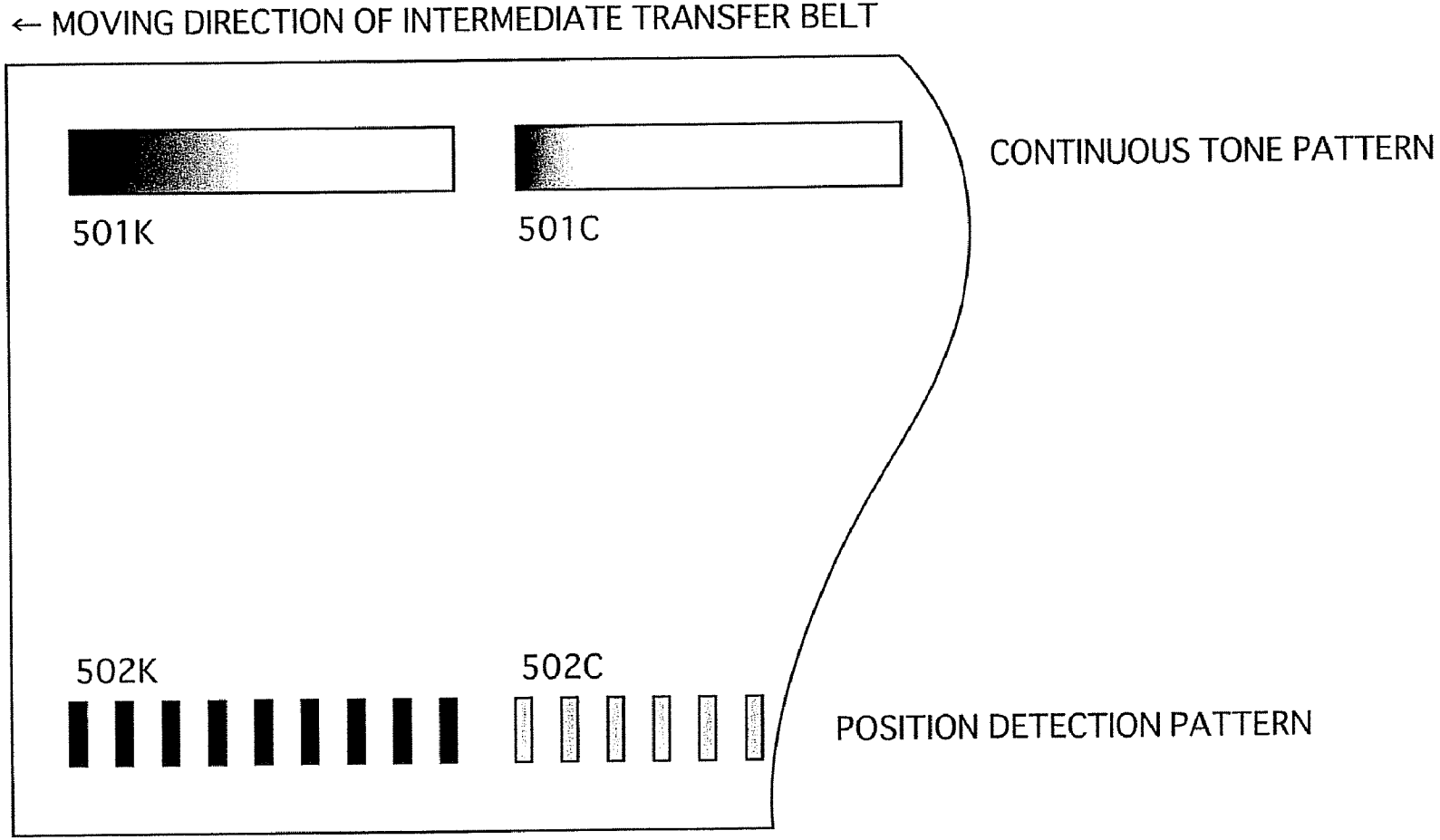
FIG. 5 is a diagram showing a test pattern used by the image forming apparatus 1 in the image stabilization process.

The test pattern includes, as shown in FIG. 5, a continuous tone pattern and a position detection pattern which are respectively placed at different edges of the intermediate transfer belt. The continuous tone pattern and the position detection pattern are paired for each color of CMYK. For example, a continuous tone pattern of K, 501K, and a position detection pattern of K, 502K, are placed at the same position with respect to a sub scanning direction (moving direction of the intermediate transfer belt) and are formed at different edges of the intermediate transfer belt, respectively.

The continuous tone pattern is a rectangular-shaped toner pattern whose longitudinal direction lies in the sub scanning direction, with its width in a main scanning direction being 256 dots. In addition, the tone level in the continuous tone pattern varies by 1 every 16 dots in the longitudinal direction (series gradation) Thus, the tone varies only slightly at a time in the sub scanning direction, allowing the optical sensor 109 to detect the tone accurately.

The position detection pattern includes only 17 rectangular segments being placed along the sub scanning direction, and each rectangular segment is 200 dots long and 24 dots wide, a longitudinal direction thereof lying in the main scanning direction (at right angles with the sub scanning direction).

Figure 6:
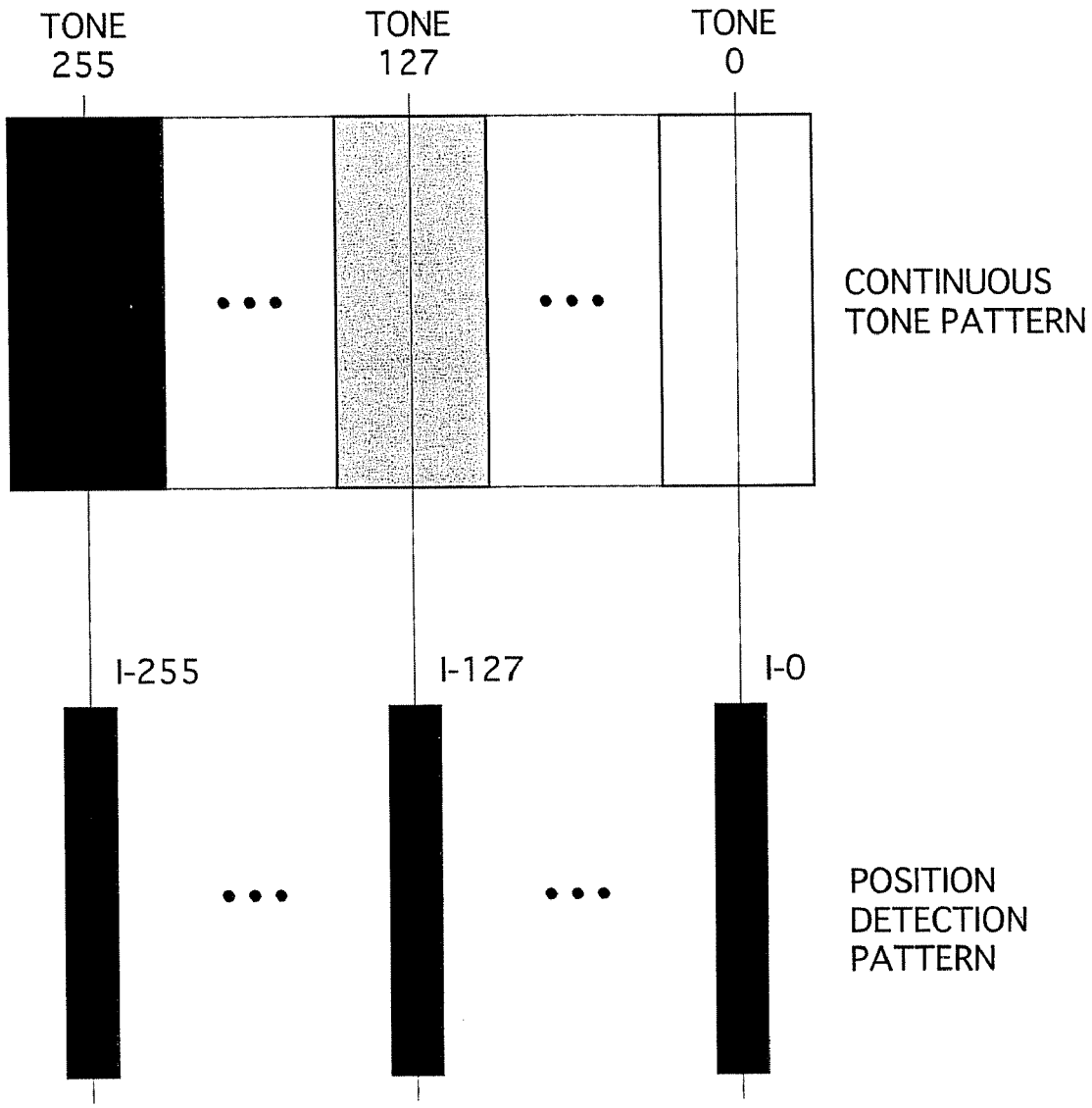
FIG. 6 is a diagram showing a positional relationship between a continuous tone pattern and a position detection pattern that are included in the test pattern used by the image forming apparatus 1.

FIG. 6 is a diagram showing a positional relationship between a continuous tone pattern and a position detection pattern that are included in the test pattern used by the image forming apparatus 1. As shown in FIG. 6, the respective rectangular segments of the position detection pattern are formed in positions corresponding to different tones in the continuous tone pattern. In the present embodiment, each rectangular segment, I-0, I-15, I-31, . . . , I-239, I-255 is formed in a position whose barycenter corresponds, in the sub scanning direction, to that of each tone 0, 15, . . . , 111, 127, 143, . . . , 239, 255, in the continuous tone pattern, respectively.

Here, even when the position of the continuous tone pattern or the position detection pattern changes in the sub scanning direction due to variance in a moving speed of the photosensitive drums 103Y to 103K or the intermediate transfer belt 102, a relative positional relationship between the continuous tone pattern and the position detection pattern with respect to the sub scanning direction does not change. Consequently, a portion including a predetermined tone value in the continuous tone pattern can be determined based on the position of each rectangular segment of the position detection pattern.

For example, the image forming apparatus can determine a barycentric position, in the sub scanning direction, for each rectangular segment of the position detection pattern and measure the tone value of the continuous tone pattern in the determined position (S403). In this way, how the tone correction needs to be performed can be found out.

It should be noted that the barycentric position can be determined by, for example, quantizing a signal outputted from the optical sensor 109 based on whether the signal exceeds an appropriately-set threshold (1) or not (0), and calculating an arithmetic mean of coordinate values, in a time coordinate, of part in which the signal consecutively exceeds the threshold.

Figure 7:
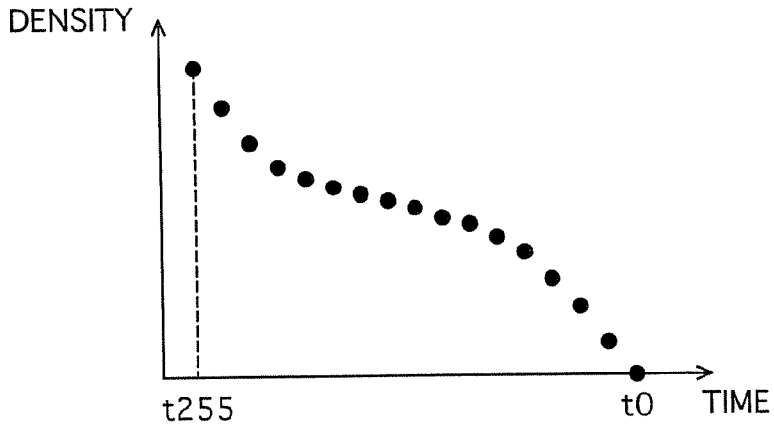
FIG. 7 is a graph showing an exemplary relationship of a time determined by a barycentric position of the position detection pattern and a density detection value of the continuous tone pattern.

FIG. 7 is a graph showing an exemplary relationship of a time determined by a barycentric position of the position detection pattern and a density detection value of the continuous tone pattern. FIG. 7 shows a case where density of the continuous tone pattern is detected from a high-density portion to a low-density portion. Accordingly, a time t0 at which the lowest-density portion is detected comes later than a time t255 at which the highest-density portion is detected.

The time t0 is a time at which a tone value 0 in the continuous tone pattern is detected, and the time t255 is a time at which a tone value 255 is detected. Based on the above, a relationship between the tone value to be printed by the image forming apparatus 1 and the density value detected by the optical sensor 109 can be determined.

Figure 8:
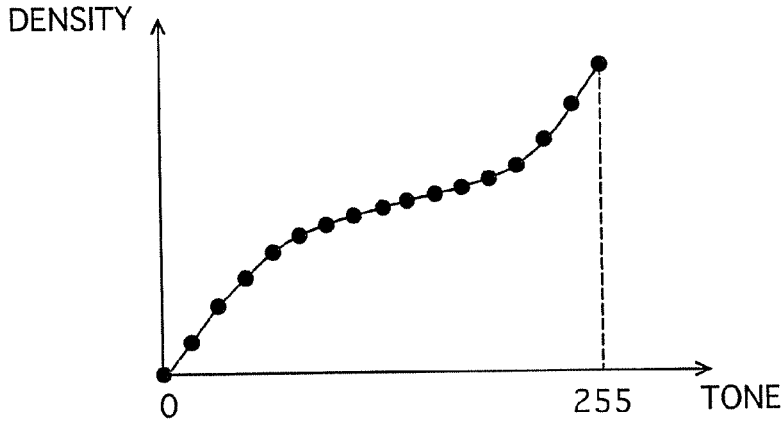
FIG. 8 is a graph showing an exemplary tone characteristic curve.

FIG. 8 is a graph showing an exemplary tone characteristic curve. As mentioned above, this tone characteristic curve shows the tone characteristic from which an effect of positional variance in the sub scanning direction caused by the speed variance or the like of the intermediate transfer belt is eliminated.

Figure 9:
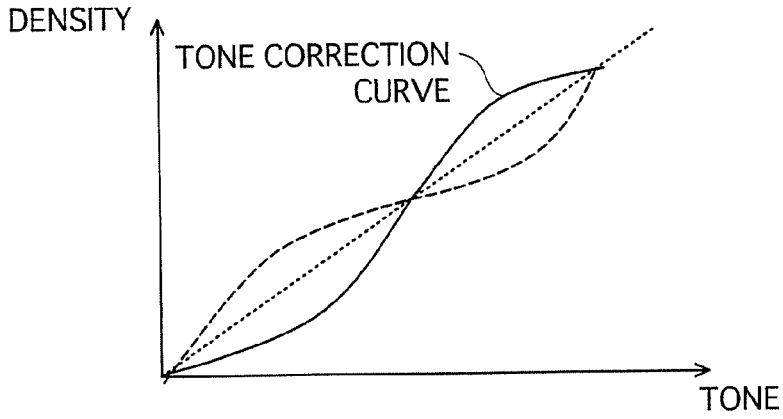
FIG. 9 is a graph showing an exemplary relationship of the tone characteristic curve and a tone correction curve.

Here, the description goes back to FIG. 4. After finding out the tone characteristic (S404) as mentioned above, the image forming apparatus 1 determines the tone correction table (S405). FIG. 9 is a graph showing an exemplary relationship of the tone characteristic curve and a tone correction curve. If the tone characteristic curve can be expressed by a function f(x), then, for example, the tone correction curve can be 1/f(x). Note that "x" is a tone value before the tone correction.

With the above processes, the image forming apparatus 1 determines a new tone correction table (S405) and updates the tone correction table (S406). Thereafter, the tone correction is performed referring to the updated tone correction table.

[4] Modifications

Up to now, the present invention has been described based on the embodiment. However, it is obvious that the present invention is not limited to the above embodiment, and the following modifications can be implemented.

(1) While the tone characteristic curve is determined by detecting density values of 17 points in the continuous tone pattern in the above embodiment, it is obvious that the present invention is not limited to this, and can be as below instead.

For instance, a density value of every tone of the continuous tone pattern can be detected with the optical sensor by dividing each gap between adjacent rectangular segments into equal parts while keeping a number of the rectangular segments of the position detection pattern at 17. Also, the number of the rectangular segments of the position detection pattern can be other than 17.

(2) While the position detection pattern is used to determine a value of which timing, among the detected density values in the continuous tone pattern, is to be referred to in the above embodiment, it is obvious that the above invention is not limited to this, and the following can be implemented instead.

Figure 10:
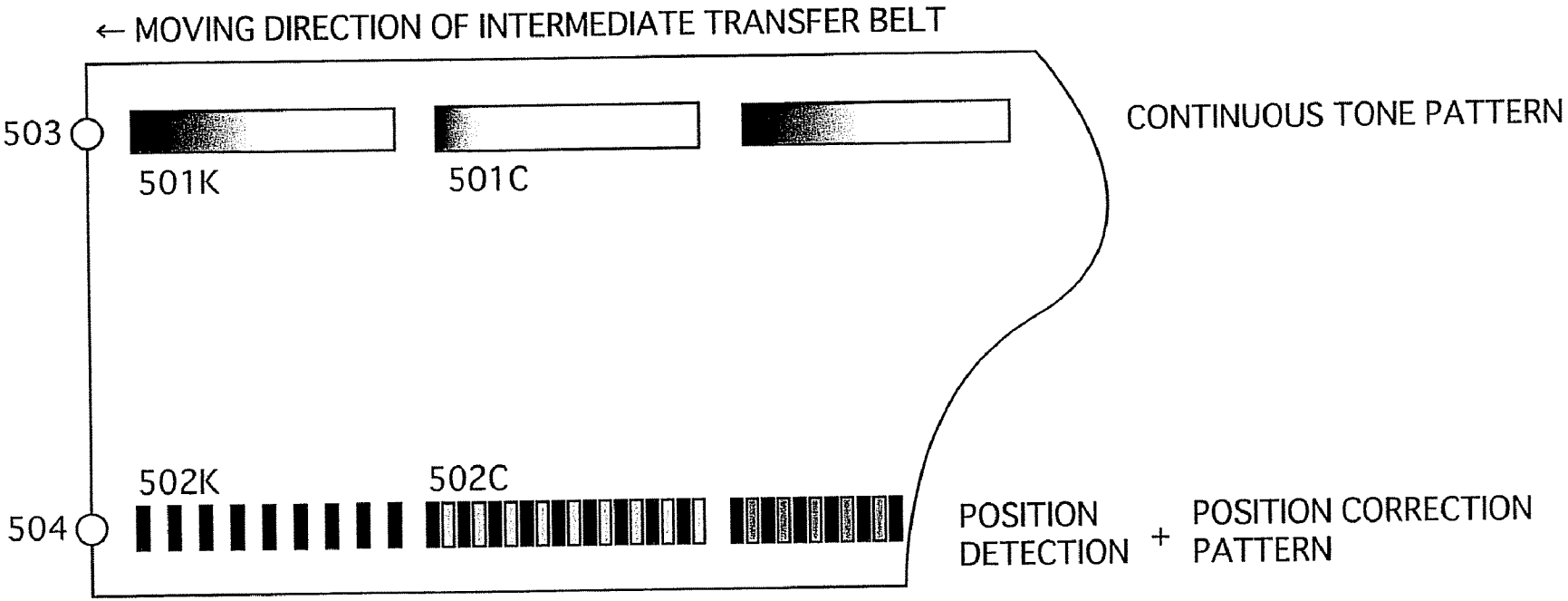
FIG. 10 is a diagram showing a test pattern pertaining to a modification (2) of the present invention.

For example, the position detection for the tone correction and the position correction of the respective colors can be performed simultaneously. FIG. 10 is a diagram showing a test pattern pertaining to a modification (2) of the present invention. FIG. 10 illustrates a test pattern including a continuous tone pattern 503 and a position detection and position correction pattern 504. By using the test pattern such as the one shown in FIG. 10, a positional shift between black and other colors can be detected by determining, in the position detection and position correction pattern 504, a difference between a time at which a rectangular segment of the black is detected and a time at which a rectangular segment of the other colors (cyan, magenta, yellow) is detected.

By giving a feedback of this detected result to a print timing control of each color, the color shift occurring during formation of a color image can be resolved.

(3) While, in the above embodiment, the description was given on the case where the tone level in the continuous tone pattern varies by 1, it is obvious that the present invention is not limited to this, and, alternatively, the tone level can vary by 2 or more. This way, the length of the continuous tone pattern with respect to the sub scanning direction can be shortened, reducing a time required to perform the image stabilization process as a result.

Also, while, in the above embodiment, the description was given on the case where the tone level in the continuous tone pattern gradually becomes lower along the sub scanning direction, it is obvious that the present invention is not limited to this, and thus the tone level can become higher along the sub scanning direction. Or, the tone level can become both higher and lower.

In any of these cases, an effect of the present invention is the same, which is to keep, with use of the position detection pattern, the accuracy from falling due to the speed variance of the intermediate transfer belt or the like.

It should be noted here that while the accuracy of the detection of the density value by the optical censor is affected by a condition of a vicinity area of the pattern which is to be detected, varying the tone level by 1 keeps a difference in density from the vicinity area small, thus allowing improvements on the detection accuracy of the density value. In addition, length, in the sub scanning direction, of an area having the same tone level can be shortened.

(4) While, in the above embodiment, the description was given on the case where the test pattern is transferred onto the intermediate transfer belt, it is obvious that the present invention is not limited to this, and the following can be implemented instead.

Figure 11:
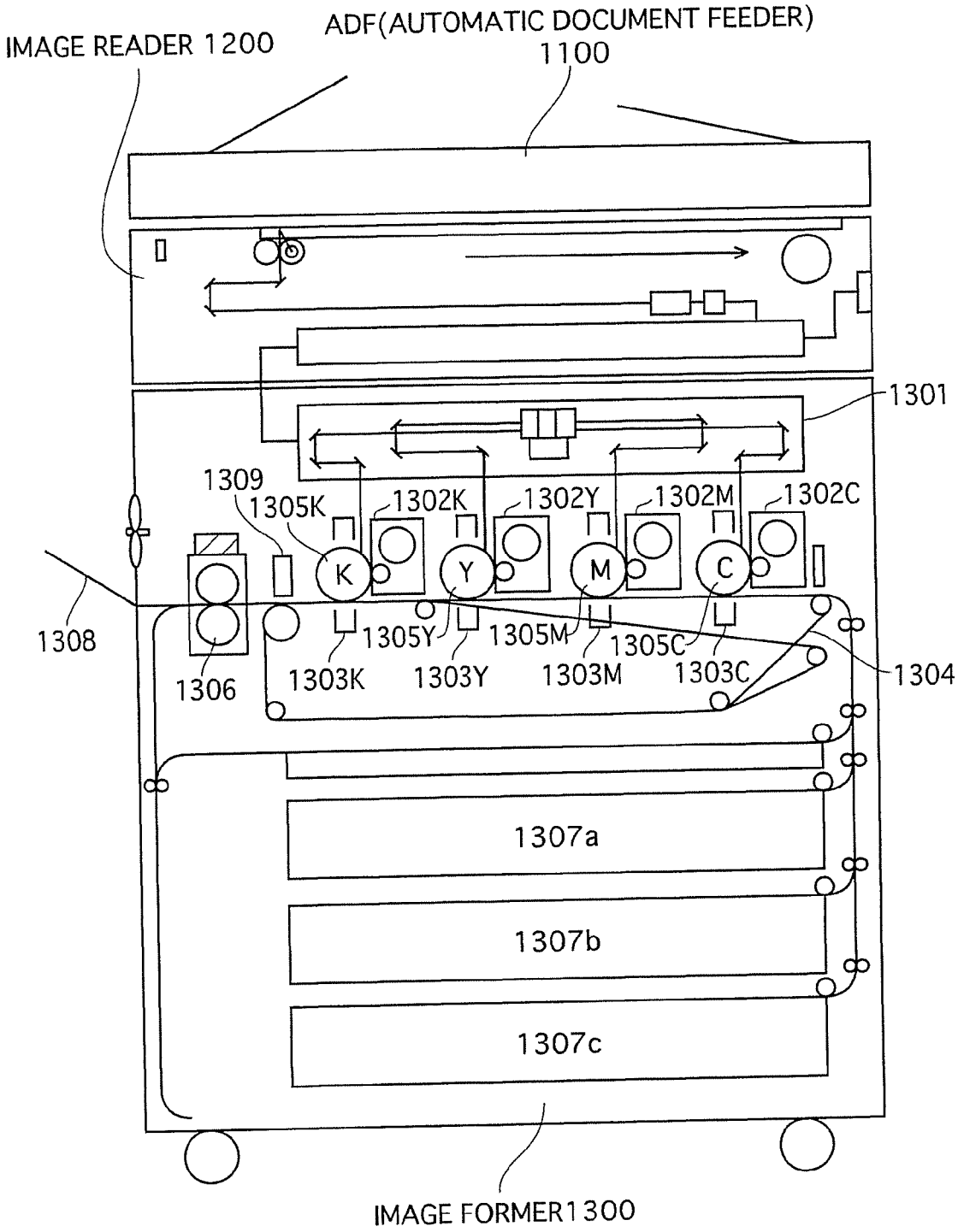
FIG. 11 is a diagram showing a structure of an image forming apparatus pertaining to a modification (4) of the present invention.

For instance, the test pattern can be transferred onto the transport belt which transports a sheet of recording paper, and the tone characteristic curve can be determined by detecting the above transferred test pattern. FIG. 11 is a diagram showing a structure of an image forming apparatus pertaining to a modification (4) of the present invention. As shown in FIG. 11, the image forming apparatus 11 is a tandem-type full-color copier, and includes an ADF (Automatic Document Feeder) 1100, an image reader 1200, and an image former 1300.

Also, the image former 1300 includes an exposing device 1301, developing devices 1302K to 1302C, transfer chargers 1303K to 1303Y, a transport belt 1304, photoconductors 1305K to 1305Y, a fixing device 1306, paper feeding cassettes 1307*a* to 1307*c*, a paper ejector 1308 and an optical sensor 1309.

The image former 1300 forms electrostatic latent images of the test pattern on the photoconductors 1305K to 1305Y with use of the exposing device 1301. The electrostatic latent images of the test pattern, formed on the photoconductors 1305K to 1305Y, are developed by the developing devices 1302K to 1302C, turning into toner patterns as a result.

The developed toner patterns are transferred onto the transfer belt 1304 by the transfer chargers 1303K to 1303Y. The optical sensor 1309 detects the test pattern on the transport belt 1304. After that, the test pattern is scraped by a cleaner (illustration omitted).

Note that when a regular image formation is performed, toner patterns are transferred from the photoconductors 1305K to 1305Y onto a sheet of recording paper that is fed from one of the paper feeding cassettes 1307*a* to 1307*c* and is electrostatically adsorbed on a surface of the transport belt 1304. The toner patterns are then fixed onto the recording paper by the fixing device 1306, and the recording paper is ejected to the paper ejector 1308.

When the test pattern is formed on the transport belt 1304 as above, the tone correction table can be updated, as in the above embodiment, by determining the tone characteristic curve while eliminating an effect such as speed variance of the transport belt.

(5) While no particular description was given in the above embodiment, the position detection pattern can be used for the registration correction as well as for the detection of the tone characteristic. That is, by detecting a position of a formed test pattern of K and those of CMY, a positional shift of CMY with respect to K can be corrected.

(6) While, in the above embodiment, a position, of a desired tone level in the continuous tone pattern is determined by finding out a barycentric position of each rectangular segment in the position detection pattern, it is obvious that the present invention is not limited to this. That is, in place of the barycenter, a different feature such as an edge position of each rectangular segment, can be used to determine the position of the desired tone level in the continuous tone pattern.

Although the present invention has been fully described by way of examples with reference to the accompanying drawings, it is to be noted that various changes and modifications will be apparent to those skilled in the art.

Therefore, unless otherwise such changes and modifications depart from the scope of the present invention, they should be construed as being included therein.

What is claimed is:

1. A tandem-type color image forming apparatus that conveys a toner image or a recording sheet with use of a conveyor, comprising:

a toner pattern former operable to form, on the conveyor, a toner pattern in which tone levels vary in a sub scanning direction;

a toner marker former operable to form, on the conveyor, toner markers each opposing, in a main scanning direction, a different one of tone level portions in the toner pattern so as to indicate positions of the tone level portions, each tone level portion representing a different one of the tone levels, and the toner markers being a same color as the toner pattern;

a position determiner operable to determine the positions in the sub scanning direction by reading the toner markers;

a density detector operable to detect a density of each of the tone level portions corresponding to the determined positions; and a corrector operable to correct, in an image formation, tone of image data based on a relationship between the density and a tone level of the corresponding one of the tone level portions.

2. The image forming apparatus of claim 1, wherein each of the toner markers is rectangular in shape, a longitudinal direction thereof lying in the main scanning direction, and each of the toner markers has a narrower width, in the sub scanning direction, than the opposing tone level portion.

3. The image forming apparatus of claim 1, wherein the tone levels in the toner pattern vary by 1 tone level in the sub scanning direction.

4. A tone correction method used by a tandem-type color image forming apparatus that conveys a toner image or a recording sheet with use of a conveyor, the tone correction method comprising:

a toner pattern forming step of forming, on the conveyor, a toner pattern in which tone levels vary in a sub scanning direction;

a toner marker forming step of forming, on the conveyor, toner markers each opposing, in a main scanning direction, a different one of tone level portions in the toner pattern so as to indicate positions of the tone level portions, each tone level portion representing a different one of the tone levels, and the toner markers being a same color as the toner pattern;

a position determining step of determining the positions in the sub scanning direction by reading the toner markers;

a density detecting step of detecting a density of each of the tone level portions corresponding to the determined positions; and a correcting step of correcting, in an image formation, tone of image data based on a relationship between the density and a tone level of the corresponding one of the tone level portions.

5. The tone correction method of claim 4, wherein each of the toner markers is rectangular in shape, a longitudinal direction thereof lying in the main scanning direction, and each of the toner markers has a narrower width, in the sub scanning direction, than the opposing tone level portion.

6. The tone correction method of claim 5, wherein the tone levels in the toner pattern vary by 1 tone level in the sub scanning direction.

* * * * *